US007637241B2

(12) United States Patent
Styron

(10) Patent No.: US 7,637,241 B2
(45) Date of Patent: Dec. 29, 2009

(54) PRESSURE REACTIVE PISTON FOR RECIPROCATING INTERNAL COMBUSTION ENGINE

(75) Inventor: Joshua P. Styron, Canton, MI (US)

(73) Assignee: Ford Global Technologies, Dearborn, MI (US)

( * ) Notice: Subject to any disclaimer, the term of this patent is extended or adjusted under 35 U.S.C. 154(b) by 43 days.

(21) Appl. No.: 11/926,179

(22) Filed: Oct. 29, 2007

(65) Prior Publication Data

US 2009/0107447 A1 Apr. 30, 2009

(51) Int. Cl.
*F02F 3/00* (2006.01)

(52) U.S. Cl. ..... 123/193.6; 123/78 B

(58) Field of Classification Search ..... 123/48 R, 123/48 A, 48 B, 78 AA, 78 A, 78 B, 197.4, 123/193.6, 196.3; 92/84, 256, 215
See application file for complete search history.

(56) References Cited

U.S. PATENT DOCUMENTS 2,742,027 A * 4/1956 Mausfield ..... 123/78 R
3,038,458 A * 6/1962 Mansfield ..... 123/78 R
5,755,192 A * 5/1998 Brevick ..... 123/78 B
5,970,944 A 10/1999 Kawamura
6,752,105 B2 * 6/2004 Gray, Jr. ..... 123/48 B
6,907,849 B2 6/2005 Galvin
7,055,469 B2 6/2006 Lawrence et al.

FOREIGN PATENT DOCUMENTS

| | | |
|---|---|---|
| DE | 2537221 | 3/1977 |
| DE | 3021093 A | 12/1981 |
| DE | 3117133 | 11/1982 |
| DE | 3612842 | 10/1987 |
| DE | 4005903 A1 | 8/1991 |
| GB | 2223292 A | 4/1990 |
| RU | 2006623 | 1/1994 |

* cited by examiner

*Primary Examiner*—Michael Cuff
*Assistant Examiner*—Hung Q Nguyen
(74) *Attorney, Agent, or Firm*—Julia Voutyras; Jerome Drouillard

(57) ABSTRACT

A pressure reactive piston for an internal combustion engine includes an axially directed central bore formed within a piston ring portion of the piston, which houses a slidably mounted crown which cooperates with the central bore to define a gas chamber which is closed off from the environment by means of a flexible gas seal interposed between the crown and the ring portion of the piston.

18 Claims, 4 Drawing Sheets

PRESSURE REACTIVE PISTON FOR RECIPROCATING INTERNAL COMBUSTION ENGINE

CROSS REFERENCE TO RELATED APPLICATIONS

None.

BACKGROUND OF THE INVENTION

1. Field of the Invention

The subject matter disclosed herein relates to a piston for use in a reciprocating internal combustion engine. The piston has a slidably mounted crown forming part of a gas chamber at the top of the piston. The gas chamber acts as a gas spring to suspend the piston crown.

2. Related Art

Designers of reciprocating internal combustion engines, in general and, more specifically, diesel engines, are faced with increasingly stringent regulatory requirements relating to exhaust emissions. More specifically, future regulations will require less emission of oxides of nitrogen (NOx), particulate matter (PM), and unburned hydrocarbons (HC). It is known that an effective way to control NOx is to decrease the peak temperatures within the combustion chamber, as well as by decreasing the available oxygen through exhaust gas recirculation (EGR). Both of these remedial actions tend, however, to cause increases PM and HC emissions. Fixation of nitrogen occurs at a very high rate above 2000° K. On the other hand, hydrocarbon formation tends to increase sharply below 1500° K. Accordingly, if peak combustion chamber temperature is lowered, NOx may be reduced, but at the expense of producing more hydrocarbon. Late ignition timing, sometimes termed ignition timing retard, may be used to reduce NOx formation. This will have the effect of causing cylinder temperature to fall below 1500° K, resulting in higher hydrocarbon, and increased fuel consumption.

It would be possible to simultaneously produce beneficial results regarding emissions of NOx, PM, and HC while not adversely affecting brake specific fuel consumption if peak temperatures could be limited but, nevertheless, be held above 1500° K long enough to completely consume all the fuel.

It is desirable to have a pressure reactive piston allowing engine operation in a regime which simultaneously reduces the formation of NOx, PM, and HC, while not adversely affecting fuel consumption.

BRIEF DESCRIPTION OF THE INVENTION

The present pressure reactive piston allows beneficial engine operation by reducing peak temperatures and pressures within the combustion chamber, while allowing energy storage in the form of a compression of a gas housed within a gas chamber in the working piston, so as to permit later expansion of the gas and to, in effect, permit operation as if at high compression, but without the attendant formation of NOx, PM, and without the drawback of additional HC resulting from combustion temperatures which are too low.

According to an aspect of the present invention, a pressure reactive piston for an internal combustion engine includes a generally cylindrical trunk having a wrist pin boss and a generally cylindrical ring portion, located above the trunk, with the ring portion having an axially directed central bore and a number of piston ring grooves circumscribing an outer wall of the ring portion. A crown is slidably mounted in the central bore, with the crown cooperating with the central bore to define a gas chamber under the crown. A volume of compressed gas is contained within the gas chamber and is maintained within the gas chamber by a flexible gas seal interposed between the crown and the ring portion.

According to another aspect of the present invention, a flexible gas seal employed in the present piston is preferably configured as a metallic bellows or as an elastomeric member. In either case, the flexible gas seal is housed within an annular space defined by a generally cylindrical outer wall of the piston crown and a generally cylindrical inner wall of the piston's central bore, as formed in the ring portion of the piston.

According to another aspect of the present invention, the piston may be configured with a unitary, generally cylindrical ring portion having a retainer step located in an uppermost part of the bore. The retainer step maintains the slidable crown within the piston during operation of an engine equipped with the present piston. Alternatively, according to another aspect of the present invention, the crown may be slidably retained within the piston by means of an annular top land applied to an upper surface of the piston's ring portion.

According to yet another aspect of the present invention, the static pressure of the compressed gas which is installed within the piston's gas chamber may be selected to be sufficient to prevent the crown from sliding in the compressive direction with respect to the ring portion of the piston during cranking and light load operation of an engine equipped with the piston.

It is an advantage of the present pressure reactive piston that the benefits of both lower and higher compression ratio are available with a single piston. For example, the benefits of low compression ratio such as low NOx production, lower frictional losses, lower heat losses, and lower mechanical stress to engine components may be had along with the higher thermal efficiency available with a high compression piston, because movement of the piston crown in response to cylinder pressure will effectively result in a reduction in maximum cylinder temperature and maximum cylinder pressure, while nevertheless allowing work done on the compressed gas in the piston to be recaptured when the piston crown moves with respect to the ring portion of the piston during the expansion stroke of the engine.

It is yet another advantage of a pressure reactive piston according to the present invention that, compared with other variable compression ratio pistons, the present piston is fast acting, but in a repeatable fashion and with more robustness than known pressure active pistons using metallic springs or hydraulic operating systems.

Other advantages, as well as features of the present invention, will become apparent to the reader of this specification.

DETAILED DESCRIPTION OF THE PREFERRED EMBODIMENTS

Figure 1:
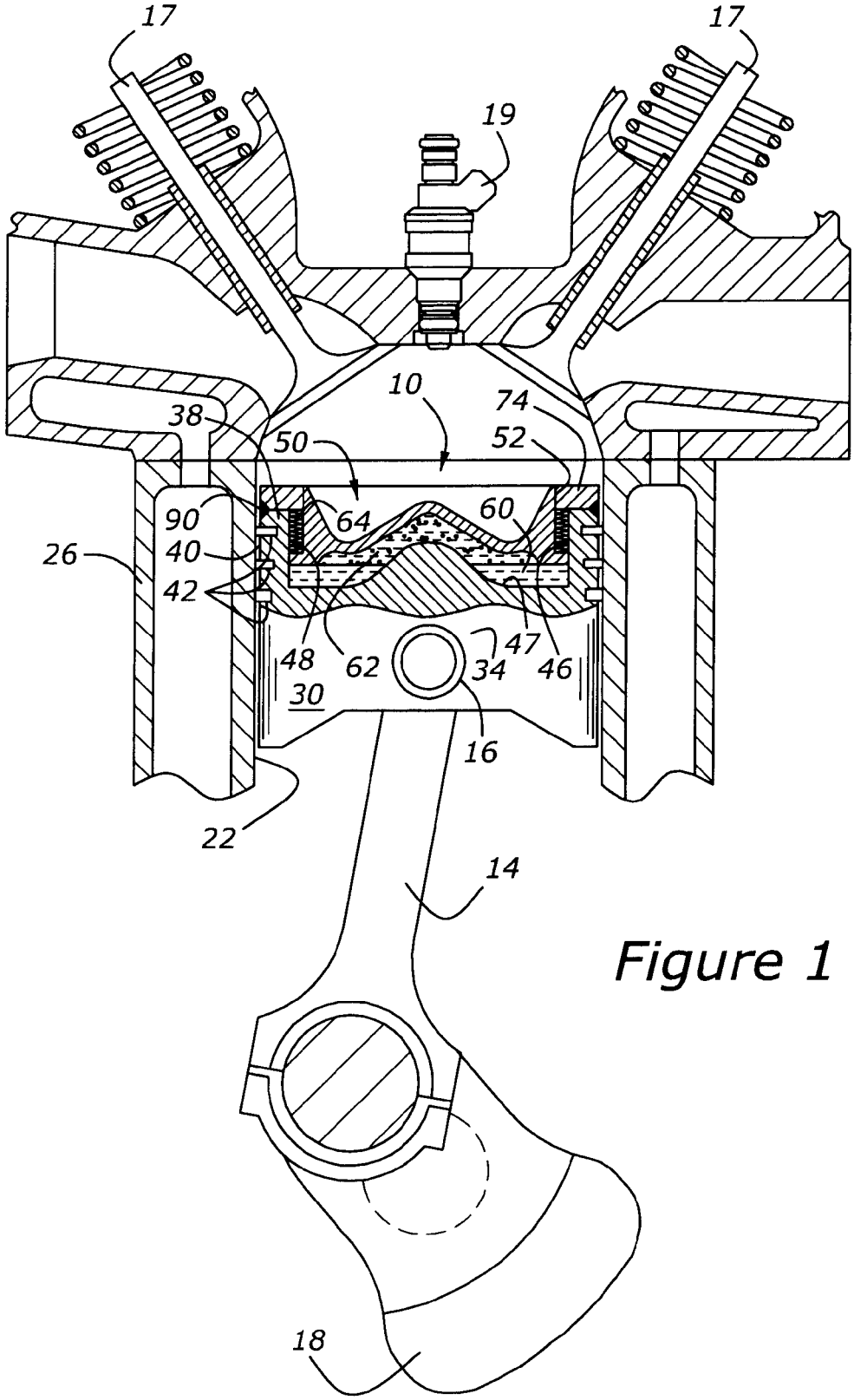
FIG. 1 illustrates a piston according to the present invention mounted within an engine. The movable piston crown is located in its highest compression, or extended, position.
Figure 2A:
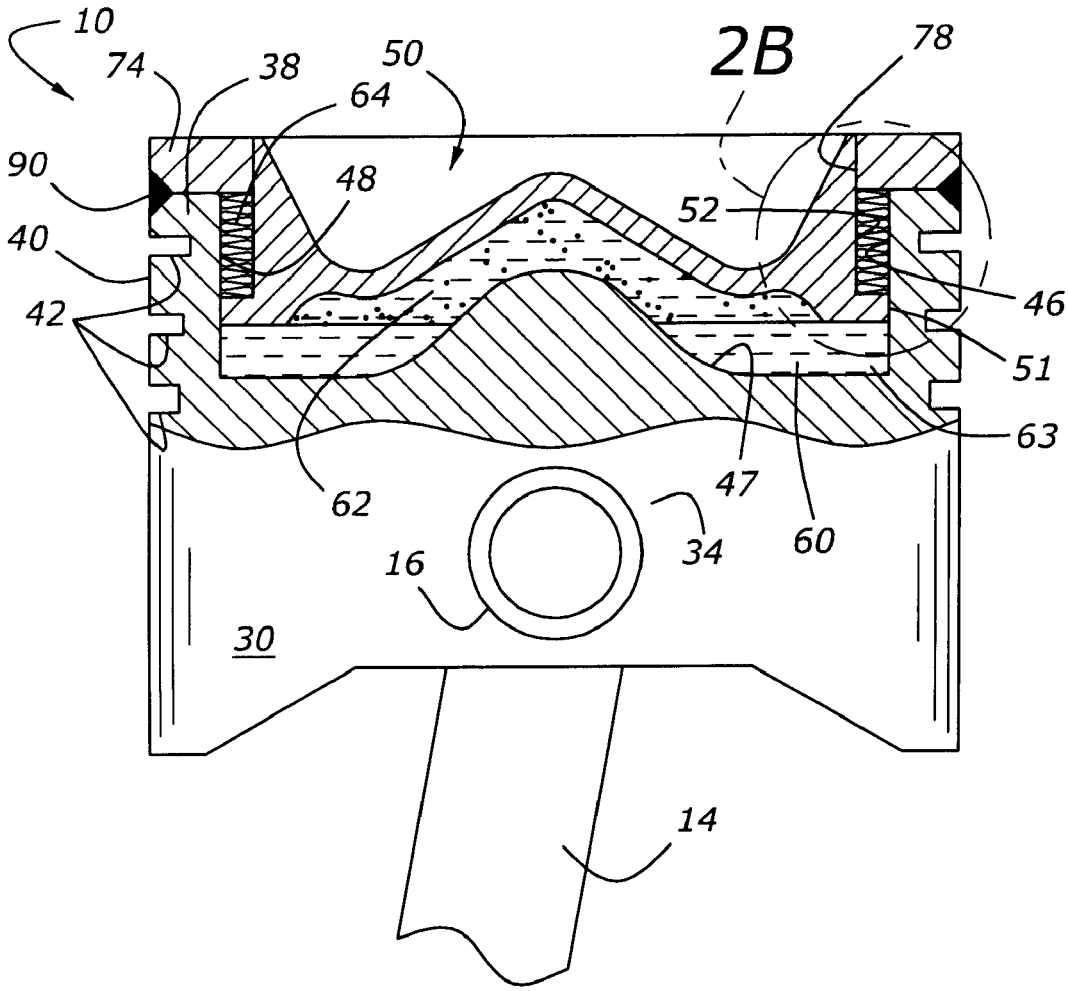
FIG. 2A is an enlarged view of the piston of FIG. 1.
Figure 2B:
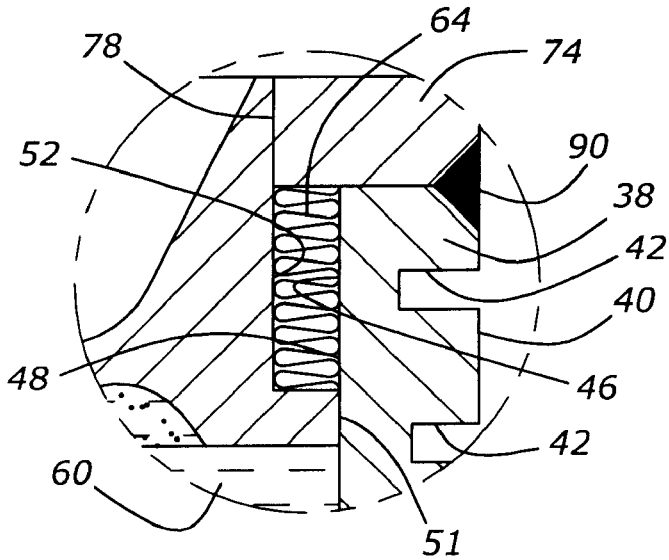
FIG. 2B is an enlarged view of a portion of FIG. 2A.
Figure 3A:
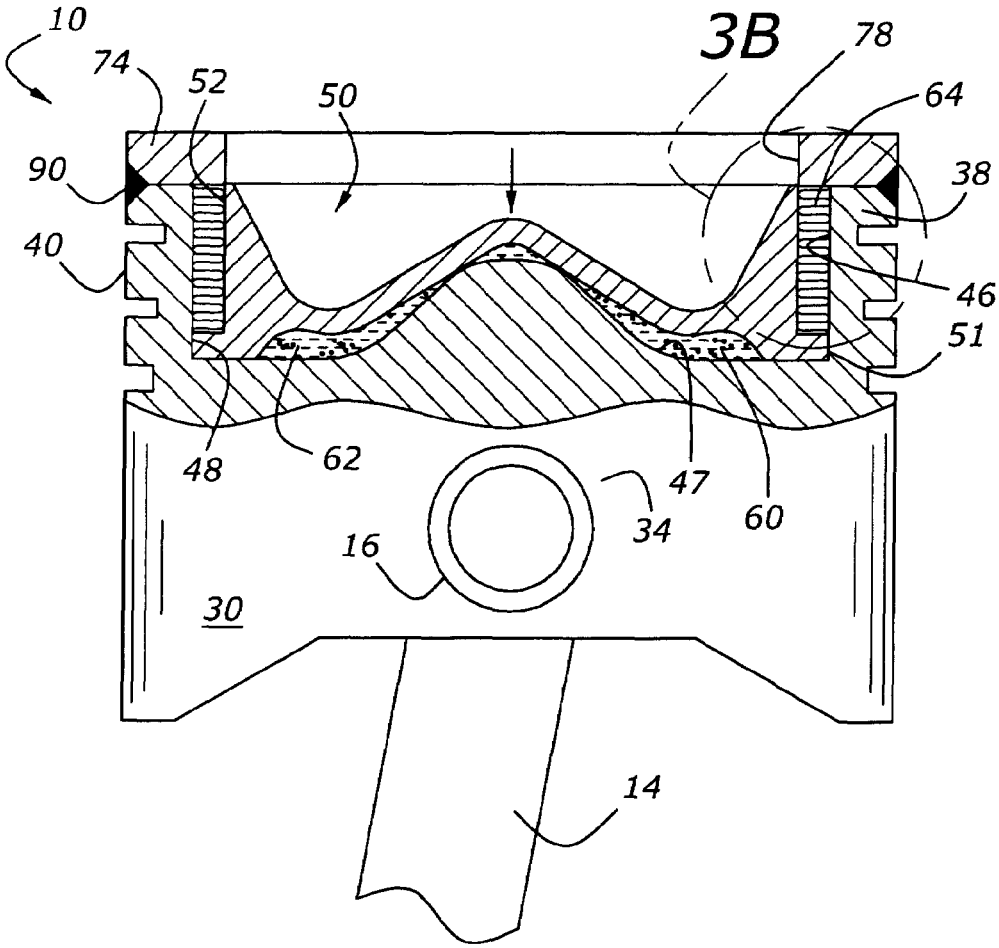
FIG. 3A is similar to FIG. 2A, but depicts the piston of FIG. 2A with the movable piston crown in its fully retracted position.
Figure 3B:
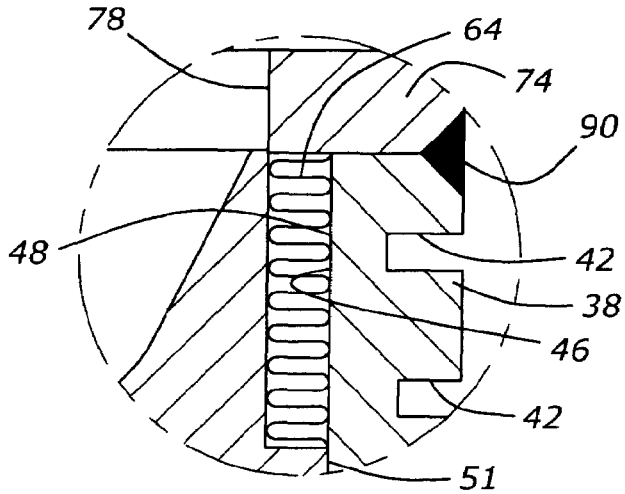
FIG. 3B is an enlarged view of a portion of FIG. 3A.

As shown in FIG. 1, piston 10 is mounted within a cylinder 22, which is carried within a cylinder block, 26. Piston 10 is attached to a connecting rod, 14, by means of a wrist pin, 16. In turn, connecting rod 14 is attached to a crankshaft, 18. The engine also includes poppet valves 17, and a fuel injector, 19. Those skilled in the art will appreciate in view of this disclosure that a piston according to the present invention may be employed with various types of reciprocating internal combustion engines, such as the illustrated diesel, or spark-ignition, or homogenous charge compression ignition (HCCI) engines, or yet other types of reciprocating engines.

Piston 10 includes a trunk, 30, which incorporates a wrist pin boss 34. The upper part of the piston includes a ring portion, 38, having an outer wall 40, and a number of piston ring grooves, 42. In the embodiment of FIGS. 1-3B, ring portion 38 is surmounted by an annular top land, 74, having an inner diameter 78, whose function will be explained below.

Piston 10 also includes an axially directed bore, 46, formed in ring portion 38. Axially directed bore 46 has an inner wall, 48, upon which a slidable piston crown, 50, is mounted.

Slidable crown 50 has two outer walls, 51 and 52. Outer wall 51 is at the lower part of slidable crown 50 and is slidably engaged with generally cylindrical inner wall 48 of axially directed central bore 46. The upper portion of outer wall 52 of piston crown 50 slidably rides upon the interior diametral surface 78 of annual top land 74.

Floor 47 of axially directed bore 46 and the underside of piston crown 50 form a gas chamber, 60, having a pre-charged volume of gas, 62, contained therein. The gas pressure is selected so that piston crown 50 will not move in a compressive direction in response to cylinder pressures encountered during at least cranking of an engine. More preferably, piston crown 50 will remain immovable with respect to the remainder of piston 10 during not only cranking but also during light load operation of an engine. This allows piston 10 to function as a higher compression ratio piston, giving excellent thermal efficiency, while not decreasing peak combustion temperature during operating regimes in which nitrogen fixation does not typically occur to a prohibitive extent. Accordingly, in FIGS. 1-2B, piston crown 50 is shown at its highest compression ratio position, whereas in FIGS. 3A-3B, piston crown 50 is shown in its lowest compression ratio position.

Figure 4:
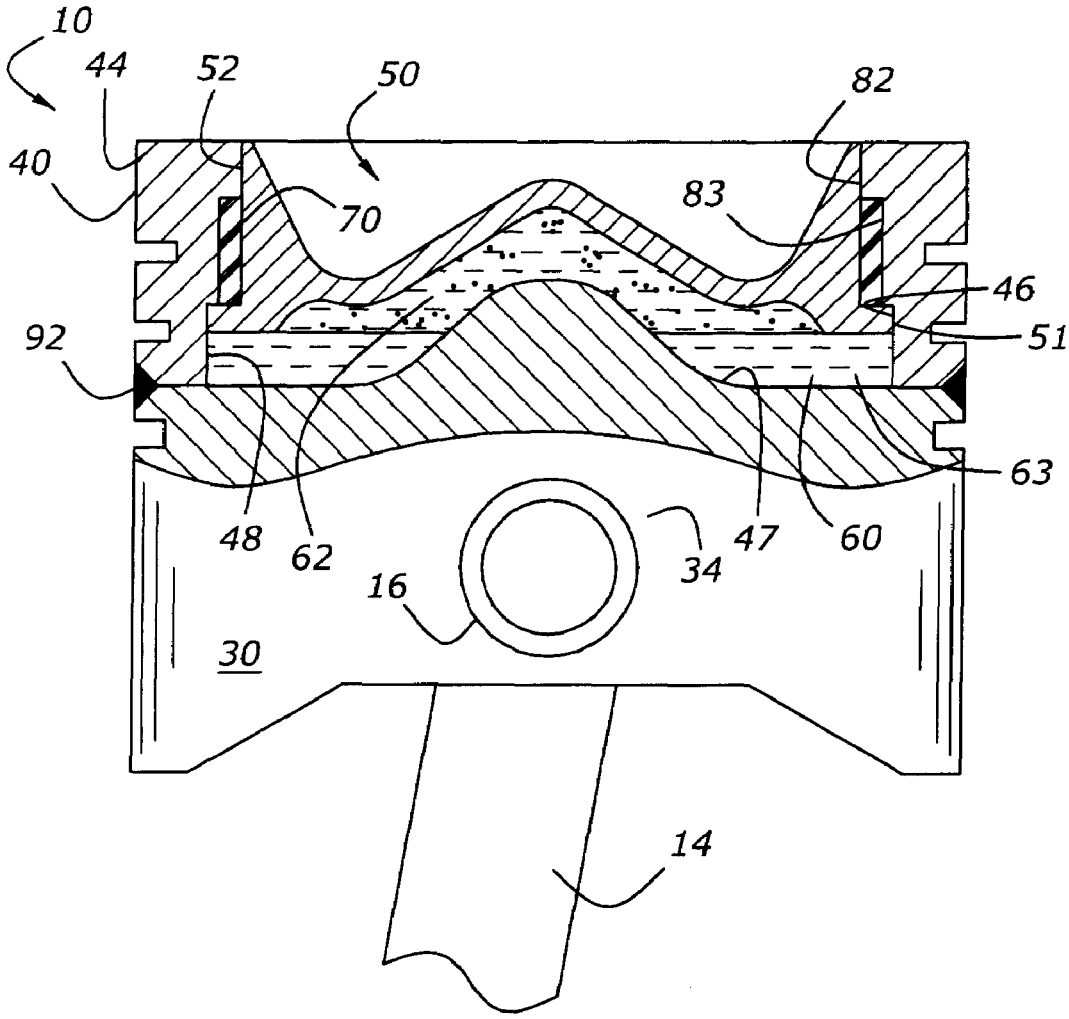
FIG. 4 is an alternate embodiment of a piston including an elastomeric gas seal.

Compressed gas 62 is contained within gas chamber 60 by means of a flexible gas seal, which is illustrated at 64 in FIGS. 1-3B and 70 in FIG. 4. As shown in FIGS. 1-3B, a flexible gas seal may be rendered as a folded metallic bellows, 64. In FIG. 4, a flexible gas seal is illustrated as an elastomeric member, 70. What is important is that the flexible gas seal be bonded to the relatively moving parts of piston 10 so that gas 62 is maintained within gas chamber 60. In its metallic configuration, 64, the bellows may be bonded to crown 50 and either top land 74 or one-piece ring portion and retainer 44 (FIG. 4), by methods such as brazing, welding, and other methods known to those skilled in the art and suggested by this disclosure. It should be understood that another advantage of the present piston resides in the fact that the gas pressures acting across the flexible gas seal are essentially equal when piston crown 50 is moving with respect to the remainder of piston 10. In effect, the gas seal must support a large pressure difference only when it is collapsed (when crown 50 is fully extended). Moreover, the gas seal is well-supported between crown 50 and bore 46.

In the embodiment illustrated in FIGS. 1-3B, piston crown 50 is confined within axially directed bore 46 by annular top land 74, which is connected with ring portion 38 either by welding, such as electron beam welding or fusion welding shown at 90, or by threaded fasteners, threaded engagement, or by other types of bonding known to those skilled in the art and suggested by this disclosure. When crown 50 is fully extended, bellows 64 is fully stacked and prevents any further upward travel of crown 50 with respect to the remainder of piston 10.

In the embodiment of FIG. 4, a single one-piece ring portion and retainer, 44, maintains piston crown 50 in slidable engagement with piston 10. In this embodiment (FIG. 4), piston crown 50 and either elastomeric seal 70 or flexible gas seal 64 are first bonded to crown 50 and to ring portion and retainer 44 before ring portion and retainer 44 are welded or bonded to trunk 30, as shown at 92 in FIG. 4. As before, such bonding may alternatively be accomplished by means of threaded fasteners or by complimentary threaded sections on ring portion 44 and trunk 30 or other types of joining known to those skilled in the art and suggested by this disclosure. A stepped portion, 83, of bore 46, prevents crown 50 from extending outwardly from the remainder of piston 10 to an extent greater than that shown in FIG. 4.

In addition to gas 62 contained within gas chamber 60, the gas chamber may also include a cooling, or heat transfer, medium, 63 (FIGS. 2A and 4), such as an aqueous based fluid containing ethylene glycol or organic acid technology coolant or some other type of antifreeze and heat transfer medium, with the heat transfer medium being stored as a liquid at room temperature, but available to move up and down within gas chamber 60 in response to the movement of piston 10. Preferably, cooling medium 63 is selected so as to change phase during operation of an engine equipped with piston 10. As is known to those skilled in the art, phase change may be employed to transfer heat very efficiently, with the cooling medium condensing on floor 47 of ring portion 38. The presence of gas chamber 60 would be expected to increase the temperature on top of crown 50, but for the fact that the movement of crown 50 so as to achieve a lower effective compression ratio during maximum load operation of the engine means that higher temperature regimes will be avoided; the use of a heat transfer medium within gas chamber 60 is a further aid to avoidance of excessive peak chamber temperatures.

Gas chamber 60 presents another advantage inasmuch as the size of the gas chamber may be adjusted so as to change the gas spring rate acting upon piston crown 50. Moreover, selection of cooling medium 63 from a class of materials which are solid at lower temperatures, but which eventually liquefy and ultimately vaporize at higher temperatures, would promote more stable operation of an engine by increasing the gas spring rate of piston 10.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. A pressure reactive piston for an internal combustion engine, comprising:

a generally cylindrical trunk having a wrist pin boss;

a generally cylindrical ring portion, located above the trunk, with said ring portion having an axially directed central bore and a plurality of piston ring grooves circumscribing an outer wall of the ring portion;

a crown slidably mounted in said central bore, with said crown cooperating with said central bore to define a gas chamber extending under the crown;

a volume of compressed gas contained within said gas chamber; and a flexible gas seal interposed between said crown and said ring portion.

2. A pressure reactive piston according to claim 1, wherein said flexible gas seal comprises a metallic bellows.

3. A pressure reactive piston according to claim 1, wherein said flexible gas seal comprises an elastomeric member.

4. A pressure reactive piston according to claim 1, wherein said flexible gas seal is housed within an annular space defined by a generally cylindrical outer wall of said crown and a generally cylindrical inner wall of said central bore.

5. A pressure reactive piston according to claim 4, wherein said annular space is further defined by a generally annular top land applied to an upper surface of said ring portion.

6. A pressure reactive piston according to claim 5, wherein said generally annular top land has an inner diameter in slidable engagement with said crown.

7. A pressure reactive piston according to claim 1, further comprising a cooling medium contained within said gas chamber.

8. A pressure reactive piston according to claim 7, wherein said cooling medium is selected so as to change phase during operation of an engine equipped with said piston.

9. A pressure reactive piston according to claim 1, wherein said trunk and said ring portion are unitary.

10. A pressure reactive piston according to claim 1, wherein said central bore within said ring portion is configured with a step at the top of the piston, so as to provide a unitary retainer for said crown.

11. A pressure reactive piston according to claim 10, wherein said ring portion is attached to said trunk after said crown has been inserted into said central bore.

12. pressure reactive piston according to claim 10, wherein said flexible gas seal comprises a metallic bellows confined within an annular space defined by a generally cylindrical outer wall of said crown, as well as by a generally cylindrical inner wall of said central bore and by said step configured at the top of the piston, with said bellows being fitted to said annular space so that the bellows will be supported by at least one of said generally cylindrical outer wall of said crown and said generally cylindrical inner wall of the central bore.

13. A pressure reactive piston according to claim 1, wherein said compressed gas is installed within said gas chamber at a pressure sufficient to prevent said crown from sliding in a compressive direction with respect to said ring portion during cranking of an engine equipped with said piston.

14. pressure reactive piston for an internal combustion engine, comprising:

a generally cylindrical trunk having a wrist pin boss;

a generally cylindrical ring portion, located above the trunk, with said ring portion having an upwardly opening, axially directed central bore and a plurality of piston ring grooves circumscribing an outer wall of the ring portion;

a crown slidably mounted in said central bore, with said crown cooperating with said central bore to define a gas chamber extending between a lower surface of the crown and an upwardly facing surface of the central bore;

a generally annual top land applied to an upper surface of said ring portion, so as to confine said crown within said central bore;

a volume of compressed gas contained within said gas chamber, with said gas having a sufficient static pressure to cause said crown to be immobile when the crown is subjected to cylinder pressures characteristic of cranking and lower load operation, while permitting the crown to compress the gas within said gas chamber during higher load operation; and a flexible gas seal interposed between said crown and said ring portion.

15. A pressure reactive piston according to claim 14, wherein said ring portion is unitary with said trunk.

16. pressure reactive piston for an internal combustion engine, comprising:

a generally cylindrical trunk having a wrist pin boss;

a generally cylindrical ring portion, located above the trunk, with said ring portion having an axially directed central bore and a plurality of piston ring grooves circumscribing an outer wall of the ring portion, and with said ring portion having a retainer step located at the uppermost part of said bore;

a crown slidably mounted in said central bore, with said crown cooperating with said central bore to define a gas chamber and with said crown being confined within said bore by said retainer step;

a volume of compressed gas contained within said gas chamber, with said gas having a sufficient static pressure to cause said crown to be immobile when the crown is subjected to cylinder pressures characteristic of cranking and lower load operation, while permitting the crown to compress the gas within said gas chamber during higher load operation; and a flexible gas seal interposed between said crown and said ring portion.

17. pressure reactive piston according to claim 16, wherein said ring portion is joined to said trunk after said crown has been slidably inserted into said central bore.

18. A reciprocating internal combustion engine, comprising:

a crankshaft;

a connecting rod attached to said crankshaft;

a cylinder block; and a pressure reactive piston attached to said connecting rod and mounted reciprocally within said cylinder block, with said piston comprising:

a generally cylindrical trunk having a wrist pin boss;

a generally cylindrical ring portion, located above the trunk, with said ring portion having an axially directed central bore and a plurality of piston ring grooves circumscribing an outer wall of the ring portion;

a crown slidably mounted in said central bore, with said crown cooperating with said central bore to define a gas chamber;

a volume of compressed gas contained within said gas chamber; and a flexible gas seal interposed between said crown and said ring portion.

* * * * *